US008671645B1

(12) United States Patent
Shriver

(10) Patent No.: US 8,671,645 B1
(45) Date of Patent: Mar. 18, 2014

(54) SAFING INSULATION WITH PRE-APPLIED SMOKE SEALANT

(75) Inventor: James Shriver, Wabash, IN (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 305 days.

(21) Appl. No.: 12/609,643

(22) Filed: Oct. 30, 2009

Related U.S. Application Data

(60) Provisional application No. 61/109,948, filed on Oct. 31, 2008.

(51) Int. Cl.
*E04B 1/00* (2006.01)
*E04G 21/00* (2006.01)
*E04G 23/00* (2006.01)

(52) U.S. Cl.
USPC ..... 52/741.4; 52/742.13; 52/745.05; 52/235; 52/404.2; 156/71; 156/77

(58) Field of Classification Search
USPC ..... 52/234, 573.1, 232, 241, 220.8, 235, 52/236.3, 236.6, 236.7, 236.8, 236.9, 262, 52/264, 481.1, 481.2, 404.2, 407.2, 511, 52/506.05, 741.4, 742.13, 745.05; 156/71, 156/77
See application file for complete search history.

(56) References Cited

U.S. PATENT DOCUMENTS

| | | | | |
|---|---|---|---|---|
| 2,007,683 | A | | 7/1935 | Kreutzer |
| 2,391,792 | A | | 12/1945 | Miles et al. |
| 2,592,634 | A | | 4/1952 | Wilson |
| 3,462,901 | A | | 8/1969 | Jamgochian |
| 3,604,167 | A | | 9/1971 | Hays |
| 3,715,848 | A | | 2/1973 | Jordan |
| 3,786,604 | A | * | 1/1974 | Kramer ..... 52/232 |
| 4,449,341 | A | * | 5/1984 | Taglianetti et al. ..... 52/235 |
| 4,546,582 | A | | 10/1985 | Gartner |
| 4,677,731 | A | | 7/1987 | Sommerer et al. |
| 4,917,554 | A | | 4/1990 | Broom |
| 4,977,719 | A | | 12/1990 | LaRoche et al. |

(Continued)

FOREIGN PATENT DOCUMENTS

| | | |
|---|---|---|
| GB | 2142952 | 1/1985 |
| WO | 93/23245 | 11/1993 |

OTHER PUBLICATIONS

Thermafiber Smoke Seal Compound, Submittal Sheet 07840, United States Gypsum Company, 1993.
3M FireDam Spray 200, Product Data, 3M, 2006.

(Continued)

*Primary Examiner* — Chi Q Nguyen
(74) *Attorney, Agent, or Firm* — Calfee, Halter & Griswold LLP

(57) ABSTRACT

The present invention relates safing insulation and, particularly, to safing insulation with pre-applied smoke sealant and methods for using the same. In one exemplary embodiment, safing insulation sheets are formed from individual safing insulation sections having a layer of smoke sealant applied to the upper surface of the safing insulation sections. In order to form the safing insulation sheets, individual safing insulation sections are arranged with the fibers of each individual section extending in a vertical direction and a smoke sealant is applied thereto. The smoke sealant acts to mechanically secure the individual sections of safing insulation to one another and also eliminates the need to apply smoke sealant to the safing insulation after installation. Advantageously, by pre-applying the smoke sealant to the safing insulation, the need to use spraying equipment to apply the smoke sealant to the safing insulation at a job site is eliminated.

23 Claims, 3 Drawing Sheets

(56) References Cited

U.S. PATENT DOCUMENTS

| | | | | |
|---|---|---|---|---|
| 5,063,718 | A * | 11/1991 | Nonis | 52/235 |
| 5,765,332 | A | 6/1998 | Landin et al. | |
| 6,035,584 | A | 3/2000 | Barreto | |
| 6,698,146 | B2 | 3/2004 | Morgan et al. | |
| 6,783,345 | B2 | 8/2004 | Morgan et al. | |
| 6,857,233 | B2 | 2/2005 | Farag | |
| 7,043,880 | B2 | 5/2006 | Morgan et al. | |
| 7,152,385 | B2 | 12/2006 | Morgan et al. | |
| 7,424,793 | B1 * | 9/2008 | Shriver | 52/235 |
| 7,644,549 | B2 * | 1/2010 | Speck | 52/235 |
| 7,765,753 | B1 * | 8/2010 | Shriver | 52/235 |
| 7,827,746 | B2 * | 11/2010 | Speck | 52/235 |
| 7,856,775 | B2 * | 12/2010 | Stahl, Jr. | 52/232 |
| 7,886,491 | B1 * | 2/2011 | Shriver | 52/235 |
| 2007/0204540 | A1 | 9/2007 | Stahl, Sr. et al. | |
| 2009/0126297 | A1 | 5/2009 | Stahl, Jr. | |
| 2010/0107532 | A1 | 5/2010 | Shriver | |

OTHER PUBLICATIONS

SpecSeal Fast Tack Firestop Spray, Product Data Sheet, Specified Technologies, Inc., 2007.

SpecSeal Series AS 200 Elastomeric Spray, Product Data Sheet, Specified Technologies, Inc., 2008.

Tremco TREMstop Acrylic SP, A sprayable acrylic latex sealant, Tremco Commercial Sealants & Waterproofing, Undated.

Hilti CP 672 joint spray, Item No. 00315267, Hilti Corporation, 2008.

Product Data Sheet, Metacaulk 1200, Metacaulk 1220 SL, Metacaulk 1200 Caulk grade, Rectorseal, May 2006.

Product Data Sheet BIOSTOP 750 Spray Applied Mastic, BIOSTIOP 750 SL, BIOSTOP 750 Caulk Grade, Rectorseal, May 2006.

Office action from U.S. Appl. No. 12/609,106 dated Nov. 23, 2011.

Office action from U.S. Appl. No. 12/609,106 dated Aug. 9, 2012.

Notice of Allowance from U.S. Appl. No. 12/609,106 dated Jul. 11, 2013.

Office action from Canadian Application No. 2,684,179 dated May 25, 2011.

Office action from Canadian Application No. 2,684,179 dated Jun. 26, 2013.

Product Information, Thermafiber, Inc. "Impasse Curtain Wall Insulation System", Jul. 2005.

* cited by examiner

SAFING INSULATION WITH PRE-APPLIED SMOKE SEALANT

CROSS-REFERENCE TO RELATED APPLICATIONS

This application claims the benefit under title 35 U.S.C. §119(e) of U.S. Provisional Patent Application Ser. No. 61/109,948, entitled SAFING INSULATION WITH PRE-APPLIED SMOKE SEALANT, filed on Oct. 31, 2008, the entire disclosure of which is expressly incorporated by reference herein.

BACKGROUND

1. Field of the Invention

The present invention relates to safing insulation and, particularly, to safing insulation with pre-applied smoke sealant and methods for using the same.

2. Description of the Related Art

Modern, multiple story buildings may be formed with an external wall structure that is secured to a floor slab. The external wall structure, or curtainwall, is secured to the slab, which is made of concrete, at a distance spaced away from the slab. By creating a gap between the slab and the curtainwall, proper alignment of the curtainwall is ensured. For example, in the event that the slab for a particular floor is not entirely straight or the slabs of adjacent floors are not properly aligned, the size of the gap between the curtainwall and one of the slabs may be adjusted at various points along the slab to align the curtainwall so that it is substantially straight along the entire length of the building.

While the created void or gap between the curtain wall and the slab of a building may be necessary to allow for proper alignment of the curtainwall, in the event of a fire, smoke, hot gasses, and/or flames may pass from one floor to another through the gap between the curatinwall and the slab. In order to prevent fire and/or smoke from passing freely through this gap, safing insulation may be positioned between the slab and a spandrel of the curtainwall. Specifically, the spandrel areas of the curtainwall may be backed by a layer of spandrel insulation and the safing may be positioned between the spandrel insulation and the slab in order to fill the gap between the spandrel and the slab.

In order to increase the ability of the safing insulation to prevent the passage of smoke, hot gasses, and/or fire, the safing insulation, which may be manufactured from mineral wool, for example, is compressed before being inserted between the spandrel insulation and the slab. The safing insulation is then maintained in a compressed condition between the spandrel insulation and the slab. By maintaining the safing insulation in a compressed condition, the density of the safing insulation is increased, which increases the ability of the safing insulation to prevent the passage of smoke, hot gasses, and/or fire therethrough.

For an additional barrier to the passage of smoke and/or hot gasses through the safing insulation, a smoke sealant may be applied to an upper surface of the safing insulation. Further, in order to retard to the passage of smoke and/or hot gasses through the junctions between the safing insulation and the spandrel insulation, as well as between the safing insulation and the slab, the smoke sealant may be applied to extend at least one inch onto both the spandrel insulation and the slab. While this method of application of smoke sealant is effective, it is time consuming, particular when only a small portion of safing insulation needs to be coated. For example, on a job site, it is not uncommon that additional work needs to be performed after the safing insulation and smoke sealant are installed. As a result, the additional work may result in damage to the safing insulation and/or the smoke sealant that requires replacement of the safing insulation and smoke sealant. Additionally, if the insulation is installed before the building is dried in and moisture enters the building, the safing insulation may become wet and need to be replaced. If smoke sealant has already been applied to the safing insulation, the safing insulation and its corresponding smoke sealant are removed from the gap. Then, in order to replace the removed safing insulation, a piece of safing insulation having a substantially similar size as the safing insulation that was removed is positioned between the slab and spandrel insulation and the smoke sealant is applied to the new safing, the slab, and the spandrel insulation, as necessary.

However, in order to apply the smoke sealant to the new safing insulation, spraying equipment that is used for applying the smoke sealant must be brought to the job site and moved to the location of the new safing insulation. Then, once the smoke sealant is applied to the new safing, the spraying equipment must be cleaned and removed from the job site. While this process is effective, it is both time consuming and labor intensive.

SUMMARY

The present invention relates to safing insulation and, particularly, to safing insulation with pre-applied smoke sealant and methods for using the same. In one exemplary embodiment, safing insulation sheets are formed from individual safing insulation sections having a layer of smoke sealant applied to the upper surface of the safing insulation sections. In order to form the safing insulation sheets, individual safing insulation sections are arranged with the fibers of each individual section extending in a vertical direction and a smoke sealant is applied thereto. The smoke sealant acts to mechanically secure the individual sections of safing insulation to one another and also eliminates the need to apply smoke sealant to the safing insulation after installation. Advantageously, by pre-applying the smoke sealant to the safing insulation, the need to use spraying equipment to apply the smoke sealant to the safing insulation at a job site is eliminated.

In one form thereof, the present invention provides a method of replacing a portion of safing insulation used in an exterior wall system. The exterior wall system has a spandrel and spandrel insulation positioned adjacent the spandrel. The exterior wall system is positioned a distance from a slab, wherein the distance between the spandrel insulation and the slab defines a gap therebetween. The method includes the steps of providing a safing insulation sheet including a plurality of individual sections of safing insulation. Each of the plurality of individual sections of safing insulation has an upper surface. Each of the plurality of individual sections of safing insulation are positioned adjacent to another of the plurality of individual sections of safing insulation to define longitudinal junctions therebetween. The safing insulation sheet also includes a layer of smoke sealant positioned on the upper surface of each of the plurality of individual sections of safing insulation. The layer of smoke sealant extends across each of the longitudinal junctions between the plurality of individual sections of safing insulation, whereby the layer of smoke sealant mechanically secures each of the plurality of individual sections of safing insulation together. The method also includes the step of inserting a first piece of the safing insulation sheet into the gap.

In another form thereof, the present invention provides a method of replacing a portion of safing insulation used in an exterior wall system. The exterior wall system has a spandrel and spandrel insulation positioned adjacent to the spandrel. The exterior wall system is positioned a distance from a slab, wherein the distance between the spandrel insulation and the slab defines a gap therebetween. The safing insulation is positioned within the gap and has a smoke sealant positioned thereon. The method includes the steps of removing a portion of the safing insulation and smoke sealant from the gap to create a void. The method includes the step of providing a safing insulation sheet including a plurality of individual sections of safing insulation. Each of the plurality of individual sections of safing insulation has an upper surface. Each of the plurality of individual sections of safing insulation is positioned adjacent to another of the plurality of individual sections of safing insulation to define longitudinal junctions therebetween and a layer of smoke sealant is positioned on the upper surface of each of the plurality of individual sections of safing insulation. The layer of smoke sealant extends across each of the longitudinal junctions between the plurality of individual sections of safing insulation, whereby the layer of smoke sealant mechanically secures each of the plurality of individual sections of safing insulation together. The method also includes the step of inserting a piece of the safing insulation sheet into the void.

In yet another form thereof, the present invention provides a safing insulation sheet including a plurality of individual sections of safing insulation. Each of the plurality of individual sections of safing insulation has an upper surface and a longitudinal axis. Each of the plurality of individual sections of safing insulation is positioned adjacent to another of the plurality of individual sections of safing insulation to define longitudinal junctions therebetween that extend along the longitudinal axis of each of the plurality of individual sections of safing insulation. The safing insulation sheet also includes a layer of smoke sealant on the upper surface of each of the plurality of individual sections of safing insulation. The layer of smoke sealant extending across each of the longitudinal junctions between the plurality of individual sections of safing insulation, whereby the layer of smoke sealant mechanically secures each of the plurality of individual sections of safing insulation together.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate preferred embodiments of the invention and such exemplifications are not to be construed as limiting the scope of the invention in any manner.

DETAILED DESCRIPTION

Figure 1:
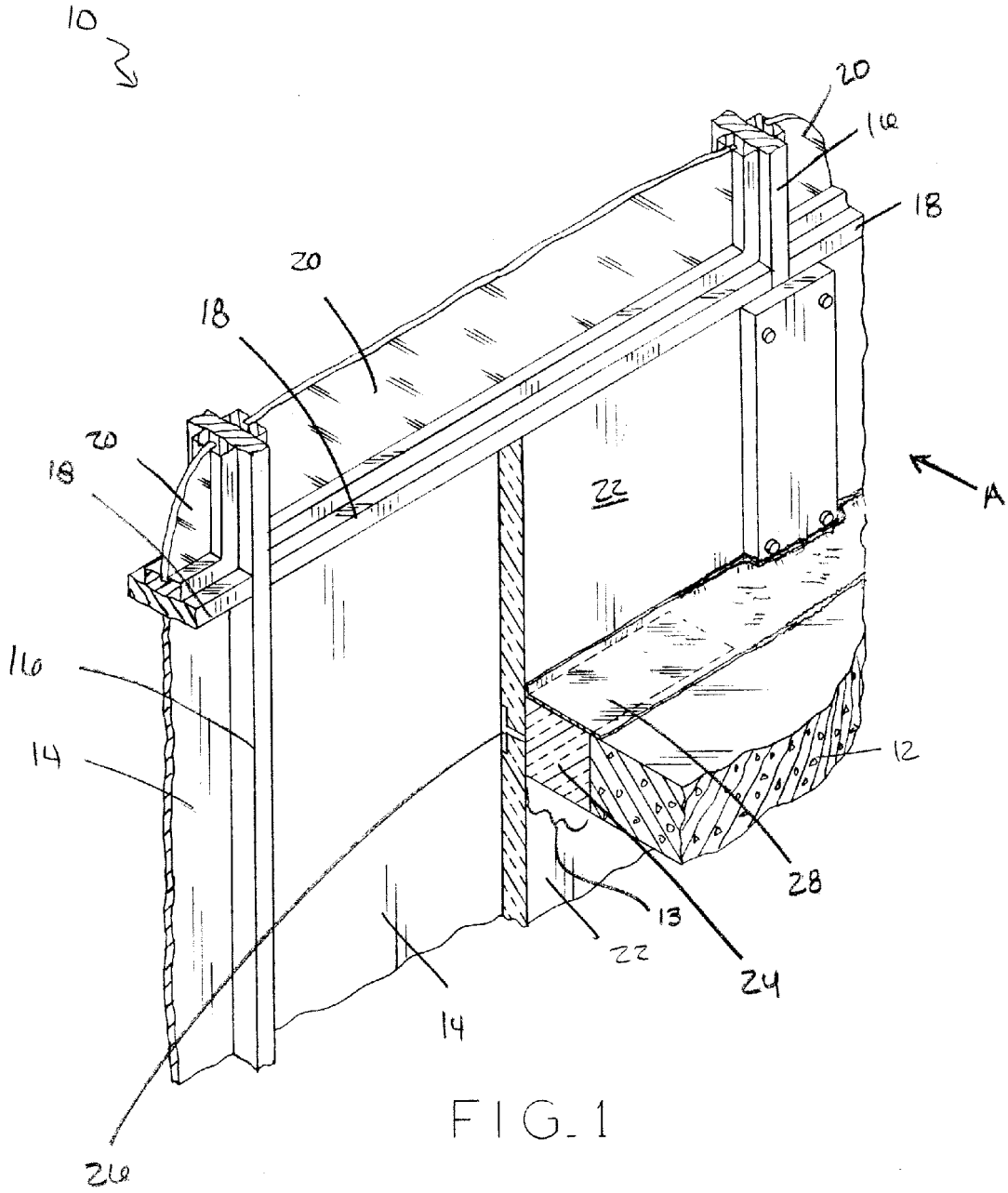
FIG. 1 is a fragmentary, partial cross-sectional, perspective view of an exterior wall system secured to a slab depicting safing insulation having a smoke sealant applied thereto in accordance with the prior art.

Referring to FIG. 1, an exterior wall system, or curtainwall, is depicted generally at numeral 10. Wall system 10 is connected to slab 12, which forms one of the floors of a multi-floor building. Wall system 10 includes spandrels 14 that define the exterior façade of the building. Spandrels 14 are secured to mullions 16, which provide the vertical framework for wall system 10. Extending between mullions 16 are transoms 18, which provide the horizontal framework for wall system 10. Additionally, vision glass 20 may be positioned between portions of mullions 16 and transoms 18. In this manner, spandrels 14 and vision glass 20, provide the visible, aesthetic features of exterior wall system 10.

Referring to FIG. 1, spandrel insulation 22 is positioned between spandrels 14 and slab 12 and, in one exemplary embodiment, is adjacent to spandrels 14. In one exemplary embodiment, the spandrel insulation may be FIRESPAN™ insulation commercially available from Thermafiber, Inc. FIRESPAN™ is a trademark of Thermafiber, Inc., of Wabash, Ind. Spandrel insulation 22 provides a first layer of fire protection for exterior wall system 10. As discussed above, wall system 10 is positioned at a distance spaced from slab 12 and secured thereto. As a result, gap 13 is created between slab 12 and wall system 10. Thus, even though spandrel insulation 22 is properly positioned, in the event of a fire, smoke, hot gasses, and/or flames may travel through gap 13 between slab 12 and wall system 10 and pass between adjacent floors of the building. In order to prevent and/or delay the passage of smoke, hot gasses, and/or fire between adjacent floors of a building, safing insulation 24 is utilized.

As shown in FIG. 1, safing insulation 24 is positioned between spandrel insulation 22 and slab 12. In one exemplary embodiment, safing insulation 24 is mineral wool insulation. For example, safing insulation 24 may be Thermafiber® Safing Insulation, commercially available from Thermafiber, Inc., of Wabash, Ind. Thermafiber® is a registered trademark of Thermafiber, Inc., of Wabash, Ind. In order to increase the density of safing insulation 24 and, correspondingly, increase the ability of safing insulation 24 to delay and/or prevent the passage of smoke, hot gasses, and/or fire through gap 13, safing insulation 24 is compressed between slab 12 and spandrel insulation 22. Specifically, safing insulation 24 may be compressed manually and then inserted between slab 12 and spandrel insulation 22. Once properly positioned, safing insulation 24 may expand to fill the gap between spandrel insulation 22 and slab 12. However, even though safing insulation 24 has slightly expanded, safing insulation 24 still remains in a compressed condition in which it has an increased density as compared to its uncompressed, i.e., neutral, condition.

Due to the compression of safing insulation 24, safing insulation 24 exerts a force on both slab 12 and spandrel insulation 22. As a result of the force applied by safing insulation 24 to spandrel insulation 22, spandrel insulation 22 may be deformed. For example, spandrel insulation 22 may deform toward spandrel 14 in the direction of arrow A of FIG. 1. As a result of the deformation of spandrel insulation 22, safing insulation 24 expands and, corresponding, decreases in density.

In order to prevent spandrel insulation 22 from deforming due to the forces exerted by compressed safing insulation 24, support structure, such as stiffening brackets and/or stiffening tees 26 shown in FIG. 1, may be used. This support structure extends between opposing mullions 16 and provides a rigid area against which safing insulation 24 may press. For example, stiffening tees 26 are sufficiently strong to resist deformation due to the forces exerted by compressed safing insulation 24. Thus, by utilizing stiffening tees 26, deformation of spandrel insulation 22 is substantially entirely prevented. Alternatively, instead of utilizing support structure, such as stiffening tees 26, any of the apparatus and methods disclosed in U.S. patent application Ser. No. 12/609,106, entitled "METHODS AND APPARATUSES FOR POSITIONING AND SECURING SAFING INSULATION", filed on even date herewith, the entire disclosure of which is expressly incorporated by reference herein, may be used.

Additionally, in order to further retard and/or prevent the passage of smoke and/or hot gasses through safing insulation 24, smoke sealant 28 may be applied thereto. Smoke sealant 28 may be any known smoke sealant the is a liquid capable of being applied on the job site using spraying equipment and that allows for the passage of no more than 5 cubic feet of smoke per linear foot of smoke sealant therethrough. For example, smoke sealant 28 may be Fast Tack™ Firestop Spray or Series AS200 Elastomeric Spray smoke sealant, commercially available from Specified Technologies, Inc. of Somerville, N.J., Smoke Sealant Compound™ smoke sealant commercially available from Thermafiber, Inc., of Wabash, Ind., FireDam™ Spray 200 smoke sealant, commercially available from 3M of St. Paul, Minn., TREMstop Acrylic SP smoke sealant, commercially available from Tremco Incorporated of Ashland, Ohio, CP 672 Joint Spray smoke sealant, commercially available from Hilti Corporation of Schann, Principality of Liechtenstein, Metacaulk® 1200, Metacaulk® 1200 SL, Metacaulk® 1200 Caulk Grade, Biostop® 750 Spray, Biostop® 750 Caulk Grade, or Biostop® 750 SL smoke sealants, commercially available from RectorSeal of Houston, Tex. Specific product data for each of the above-identified smoke sealants is set forth in the following documents: Thermafiber® Smoke Seal™ Compound, Submittal Sheet 07840, United States Gypsum Company, 1995; 3M FireDam™ Spray 200, Product Data, 3M, 2006; SpecSeal Fast Tack™ Firestop Spray, Product Data Sheet, Specified Technologies, Inc., 2007; SpecSeal Series AS200 Elastomeric Spray, Product Data Sheet, Specified Technologies, Inc., 2008; Tremco® TREMstop Acrylic SP, A sprayable acrylic latex sealant, Tremco Commercial Sealants & Waterproofing, Undated; Hilti CP 672 joint spray Item No. 00315267, Hilti Corporation, 2008; Product Data Sheet Metacaulk® 1200, Metacaulk® 1220 SL, Metacaulk® 1200 Caulk grade, Rectorseal, May 2006; and Product Data Sheet BIOSTOP® 750 Spray Applied Mastic, BIOSTOP® 750 SL, BIOSTOP® 750 Caulk Grade, Rectorseal, May 2006, the entire disclosures of which are expressly incorporated by reference herein and copies of which are filed contemporaneously herewith in conjunction with a corresponding Information Disclosure Statement.

Smoke sealant 28 is applied to safing insulation 24 to sufficiently cover the top surface of safing insulation 24 and is also applied to extend at least one inch onto slab 12 and spandrel insulation 22. By extending smoke sealant 28 onto slab 12 and spandrel insulation 22, smoke sealant 28 effectively covers the junctions between safing insulation 24 and slab 12, as well as the junction between safing insulation 24 and spandrel insulation 22.

To apply smoke sealant 28 to safing insulation 24, slab 12, and spandrel insulation 22, spraying equipment is used to spray liquid smoke sealant 28 into the desired position. Once sprayed into position, smoke sealant 28 hardens with the passage of time to form a resilient, pliable material layer. After the entirety of safing insulation 24 has been covered with smoke sealant 28 and smoke sealant 28 has hardened to form a resilient, pliable material layer, the insulation system for exterior wall system 10 is substantially complete.

Although the insulation system is now substantially complete, it may be necessary at a later time to remove a portion of safing insulation 24 and, correspondingly, smoke sealant 28, to replace and/or repair a section of damaged safing insulation 24. For example, safing insulation 24 and/or smoke sealant 28 may become damaged during other work that is being performed on the building or by moisture entering the building. Once the section of safing insulation 24 and it corresponding smoke sealant 28 are removed and any additional repairs, if necessary, are made, a piece of safing insulation 24 may be cut to the desired shape and positioned within gap 13 to fill the void created during the prior removal of when safing insulation 24 from a portion of gap 13. Then, the necessary spraying equipment must be moved to the job site and prepared for spraying smoke sealant 28 onto a relatively small portion of safing insulation 24, slab 12, and spandrel insulation 22, as described in detail above. Once the spraying is complete, the spraying equipment must be cleaned and any remaining smoke sealant 28 removed therefrom. While utilizing spraying equipment to apply smoke sealant 28 to a small portion of safing insulation 24 is effective, it is also time consuming and labor intensive.

Figure 4:
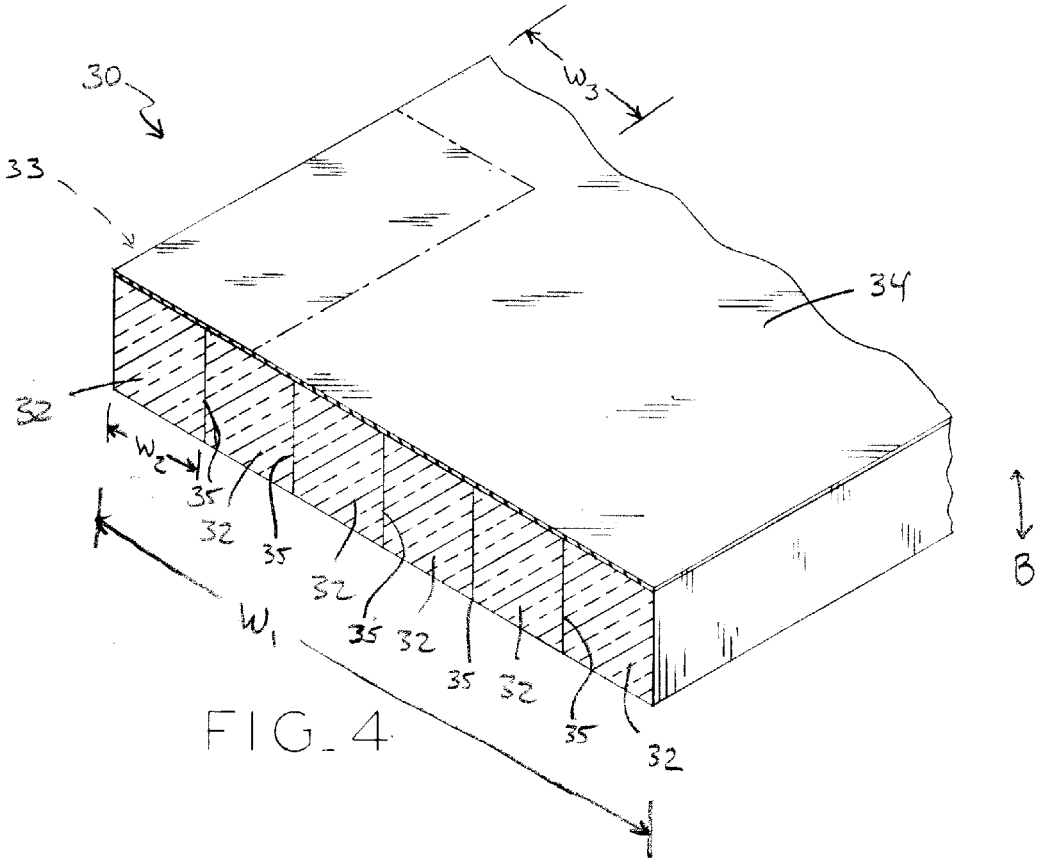
FIG. 4 is a fragmentary, perspective view of a safing insulation sheet formed from a plurality of individual safing insulation sections having a pre-applied smoke sealant.

Referring to FIG. 4, safing insulation sheet 30 is shown. Safing insulation sheet 30 includes individual safing insulation sections 32 having smoke sealant 34 applied thereto. Safing insulation sections 32 and smoke sealant 34 are substantially identical to safing insulation 24 and smoke sealant 28, respectively, described in detail above with respect to FIG. 1. When smoke sealant 34 is applied to safing insulation sections 32 to form safing insulation sheet 30, smoke sealant 34 acts to hold individual safing insulation sections 32 together and eliminates the need to apply a smoke sealant to the safing insulation after installation. In order to prepare safing insulation sections 32 for receiving smoke sealant 34, safing insulation sections 32 are arranged with the fibers in each safing insulation section 32 aligned in a vertical manner, i.e., in the direction of arrow B of FIG. 4. Each safing insulation section 32 is then placed adjacent another safing insulation section 32, forming longitudinal junctions 35 therebetween, until the desired width $W_1$ of safing insulation sheet 30 is achieved. In one exemplary embodiment, safing insulation sections 32 each have a width $W_2$ of 4 inches. In one exemplary embodiment, eight 4 inch safing insulation sections 32 are positioned adjacent one another to create safing insulation sheet 30 having a width $W_1$ of 24 inches. Additionally, it is envisioned that safing insulation sections 32 may be any width and/or some individual sections may have different widths and a plurality of safing sections 32 may combined in any manner to achieve an overall desired width $W_1$ of safing insulation sheet 30.

Once safing insulation sections 32 are positioned adjacent one another with the fibers oriented in a vertical direction, smoke sealant 34 is applied to the upper surfaces of safing insulation sections 32 in a manner in which it extends across longitudinal junctions 35 between individual safing insulation sections 32. Smoke sealant 34 may be applied utilizing spraying equipment, with a brush, or in any other manner. With smoke sealant 34 applied to sections 32, smoke sealant 34, with the passage of time, hardens from a liquid to a pliable, resilient material. In this form, smoke sealant 34, by extending across longitudinal junctions 35, acts to mechanically secure individual safing insulation sections 32 together. As a result, each individual safing insulation sheet 30 is easily transportable to and from a job site as an individual sheet 30.

Additionally, a plurality of safing insulation sheets 30 may be packaged together for easy transportation to and easy manipulation on a job site.

In order to repair an individual section of safing insulation 24, such as the section identified by dashed lines in FIG. 1, after smoke sealant 28 has been applied and the safing insulation 24 is subsequently removed to provide access to gap 13, safing insulation sheet 30 may be used. While described and depicted herein as replacing only a portion of safing insulation 24, safing insulation sheets 30 may be used as an alternative to safing insulation 24. Referring to FIG. 4, a portion of safing insulation sheet 30, such as the portion shown in the dashed line in FIG. 4, is cut to the size necessary to extend across gap 13 and to provide the desired compression to the safing insulation. For example, if gap 13 is five inches and an additional 20% of safing insulation is provided to achieve the desired compression within gap 13, a piece of safing insulation 33 will be cut having a width $W_3$ of six inches and a length that corresponds to the length of safing insulation 24 that was previously removed from gap 13 will be cut from safing insulation sheet 30. Additionally, since safing insulation sheets 30 may be manufactured in any width, safing insulation sheets 30 may formed in a desired width during manufacture to eliminate the need to cut safing insulation sheets 30 to the desired width at the job site.

Figure 2:
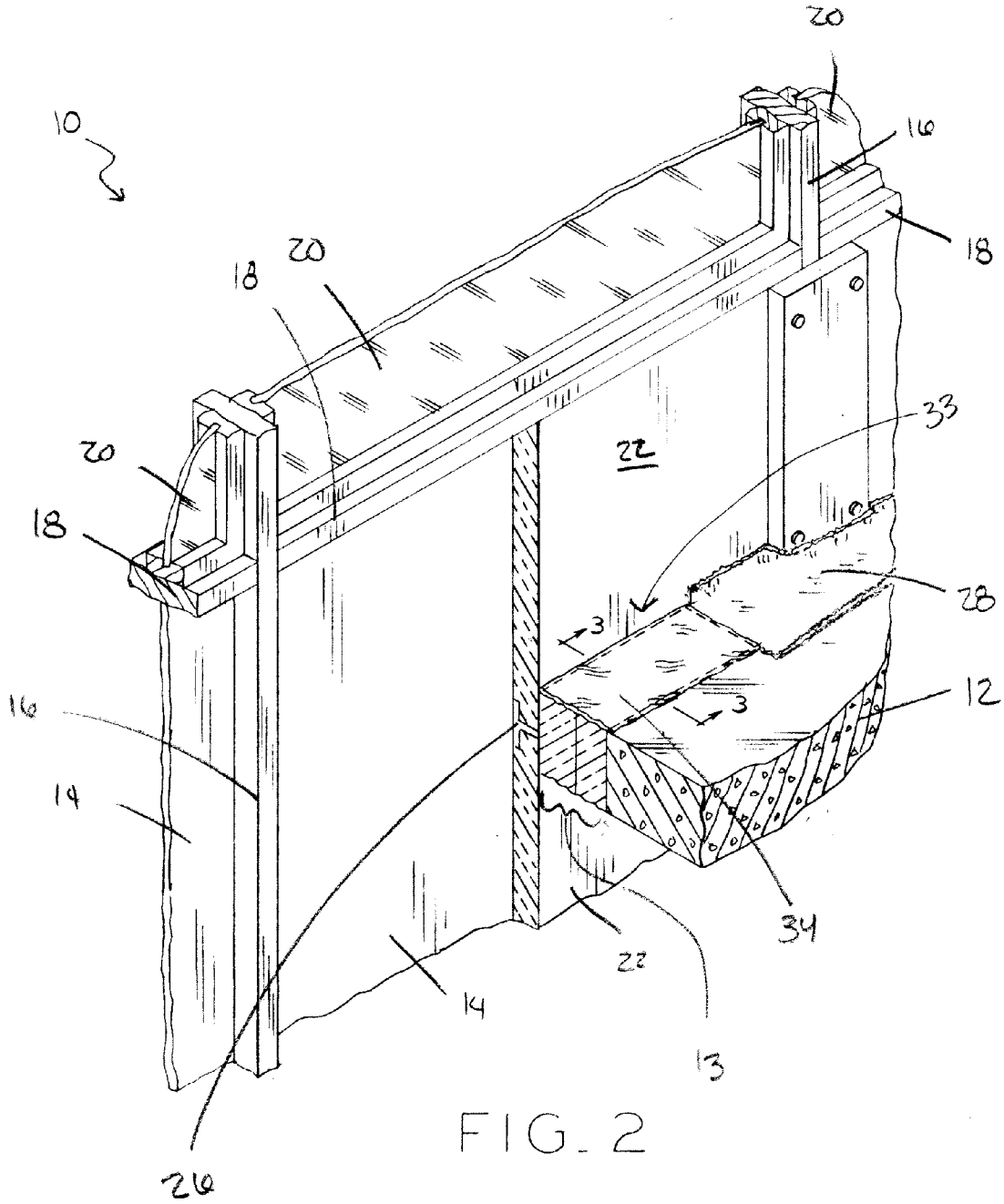
FIG. 2 is a fragmentary, partial cross-sectional, perspective view of an insulation system according to an exemplary embodiment of the present invention depicting a portion of safing insulation having a pre-applied smoke sealant.
Figure 3:
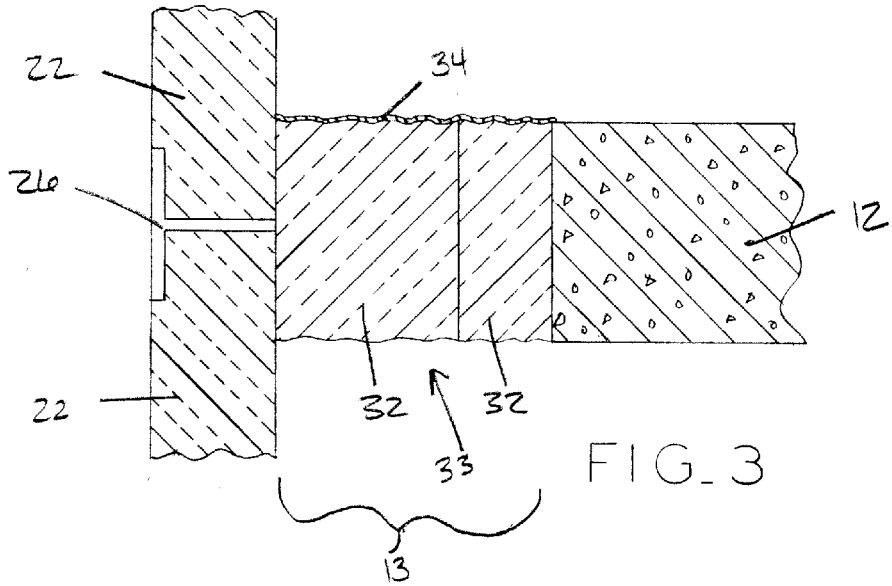
FIG. 3 is a fragmentary, cross-sectional view of the insulation system of FIG. 2 taken along line 3-3 of FIG. 2.

Referring to FIGS. 2 and 3, piece of safing insulation 33 that was cut from safing insulation sheet 30 is then compressed and inserted within gap 30 in a substantially similar manner as safing insulation 24, as described in detail above. Additionally, due to the physical properties of smoke sealant 34, smoke sealant 34, while pliable, is resilient and is not as easily deformed as safing insulation sections 32 of safing insulation sheet 30. As a result, smoke sealant 34 bunches up and exerts a force in the direction of spandrel insulation 22 and slab 12. This causes smoke sealant 34 to contact spandrel insulation 22 and slab 12 at the junctions of spandrel insulation 22 and slab 12 with safing insulation sections 32 and form a seal at the junctions. As result of the interaction of smoke sealant 34 with spandrel insulation 22 and slab 12, the need to extend smoke sealant 34 one inch onto both of slab 12 and spandrel insulation 22 may be eliminated. Moreover, even if it is desirable to apply smoke sealant 34 one inch onto slab 12 and spandrel section 22, smoke sealant 34 may be applied using a brush after the installation of safing insulation 30. This eliminates the need to utilize spraying equipment to apply the smoke sealant and, correspondingly, eliminates the costs associated with the set up and the cleaning of the spraying equipment.

Additionally, by pre-applying smoke sealant 34 onto safing insulation sections 32, the thickness of the layer of smoke sealant 34 applied to safing insulation sections 32 and, correspondingly, applied across an entire safing insulation sheet 30, may be set to a thickness that meets the smoke sealant thickness requirements for listed and tested perimeter fire containment systems. Thus, the need to monitor the thickness of a layer of smoke sealing as it is being applied on a job site and/or the need to reapply smoke sealant if the thickness is too low is substantially eliminated.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of replacing a portion of safing insulation used in an exterior wall system, the exterior wall system having a spandrel and spandrel insulation positioned adjacent the spandrel, the exterior wall system positioned a distance from a slab, wherein the distance between the spandrel insulation and the slab defines a gap therebetween, the method comprising the steps of:

providing a safing insulation sheet comprising:

a sheet of safing insulation; and a pre-applied smoke sealant applied to the sheet of safing insulation as a liquid and allowed to harden to be secured to the sheet of safing insulation;

sizing said safing insulation sheet, including both the sheet of safing insulation and the layer of pre-applied smoke sealant secured to the sheet of safing insulation, to fill at least a portion of the gap defined between the spandrel insulation and the slab to form a sized piece of safing insulation and pre-applied smoke sealant; and inserting the sized piece of safing insulation and pre-applied smoke sealant into the gap.

2. The method of claim 1, further comprising the step of cutting a first piece of safing insulation and pre-applied smoke sealant from the safing insulation sheet to form the sized piece of safing insulation, wherein the inserting step further comprises inserting the sized piece of safing insulation and pre-applied smoke sealant cut from the safing insulation sheet into the gap.

3. The method of claim 2, further comprising the steps of cutting a second piece of safing insulation and pre-applied smoke sealant from the safing insulation sheet and inserting the second piece of safing insulation and pre-applied smoke sealant cut from the safing insulation sheet into the gap.

4. The method of claim 1, further comprising, prior to the inserting step, the step of compressing the sized piece of safing insulation and pre-applied smoke sealant to form a compressed sized piece of safing insulation and pre-applied smoke sealant, wherein the inserting step comprises inserting the compressed sized piece of safing insulation and pre-applied smoke sealant into the gap.

5. The method of claim 1, further comprising the step of applying smoke sealant to at least one of the slab and the spandrel insulation adjacent to the sized piece of safing insulation and pre-applied smoke sealant inserted into the gap.

6. The method of claim 1, wherein the pre-applied smoke sealant of the safing insulation sheet allows the passage of no more than five cubic feet of smoke per linear foot of smoke sealant therethrough.

7. The method of claim 1, wherein the safing insulation sheet further comprises:

a plurality of individual sections of safing insulation, each of the plurality of individual sections of safing insulation having an upper surface, each of the plurality of individual sections of safing insulation positioned adjacent to another of the plurality of individual sections of safing insulation to define longitudinal junctions therebetween; and wherein said pre-applied smoke sealant applied to the sheet of safing insulation as a liquid and allowed to harden comprises:

a layer of pre-applied smoke sealant positioned on the upper surface of each of the plurality of individual sections of safing insulation, the layer of pre-applied smoke sealant extending across each of the longitudinal junctions between the plurality of individual sections of safing insulation, whereby the layer of pre-applied smoke sealant mechanically secures each of the plurality of individual sections of safing insulation together.

8. A method of replacing a portion of safing insulation used in an exterior wall system, the exterior wall system having a spandrel and spandrel insulation positioned adjacent the spandrel, the exterior wall system positioned a distance from a slab, wherein the distance between the spandrel insulation and the slab defines a gap therebetween, and safing insulation positioned within the gap and having a smoke sealant positioned thereon, the method comprising the steps of:

removing a portion of the safing insulation and smoke sealant from the gap to create a void;

providing a safing insulation sheet comprising:

a sheet of safing insulation; and a pre-applied smoke sealant applied to the sheet of safing insulation as a liquid and allowed to harden to be secured to the sheet of safing insulation;

sizing said safing insulation sheet, including both the sheet of safing insulation and the layer of pre-applied smoke sealant secured to the sheet of safing insulation, to fill at least a portion of the void to form a sized piece of safing insulation and pre-applied smoke sealant; and inserting the sized piece of safing insulation and pre-applied smoke sealant into the void.

9. The method of claim 8, further comprising the step of cutting the sized piece of safing insulation and pre-applied smoke sealant from the safing insulation sheet, wherein the inserting step comprises inserting the piece of safing insulation and pre-applied smoke sealant cut from the safing insulation sheet into the void.

10. The method of claim 9, further comprising, prior to the inserting step, the step of compressing the sized piece of safing insulation and pre-applied smoke sealant cut from the safing insulation sheet to form a compressed sized piece of safing insulation and pre-applied smoke sealant, wherein the inserting step comprises inserting the compressed sized piece of safing insulation and pre-applied smoke sealant into the void.

11. The method of claim 8, further comprising the step of applying smoke sealant to at least one of the slab and the spandrel insulation adjacent to the sized piece of safing insulation and pre-applied smoke sealant inserted into the void.

12. The method of claim 8, wherein the pre-applied layer of smoke sealant of the safing insulation sheet allows for the passage of no more than five cubic feet of smoke per linear foot of smoke sealant therethrough.

13. A safing insulation sheet, comprising:

a plurality of individual sections of safing insulation, each of said plurality of individual sections of safing insulation having an upper surface and a longitudinal axis, each of said plurality of individual sections of safing insulation positioned adjacent to another of said plurality of individual sections of safing insulation to define longitudinal junctions therebetween, said longitudinal junctions extending along said longitudinal axis of each of said plurality of individual sections of safing insulation; and a layer of smoke sealant on said upper surface of each of said plurality of individual sections of safing insulation, said layer of smoke sealant further extending across each of said longitudinal junctions between said plurality of individual sections of safing insulation, whereby said layer of smoke sealant mechanically secures each of said plurality of individual sections of safing insulation together.

14. The safing insulation sheet of claim 13, wherein fibers of each of said plurality of individual sections of safing insulation are oriented in a vertical manner perpendicular to said longitudinal axis of each of said plurality of individual sections of safing insulation and perpendicular to said layer of smoke sealant.

15. The safing insulation sheet of claim 13, wherein each of said plurality of individual sections of safing insulation has an individual section width, said individual section width of each of said plurality of individual sections of safing insulation cooperatively defining an overall width of the safing insulation sheet.

16. The safing insulation sheet of claim 15, wherein said individual section width of at least one of said individual sections of safing insulation is substantially equal to four inches.

17. The safing insulation sheet of claim 15, wherein said overall width is substantially equal to twenty-four inches.

18. The safing insulation sheet of claim 13, wherein said layer of smoke sealant allows the passage of no more than five cubic feet of smoke per linear foot of smoke sealant therethrough.

19. A method of insulating, comprising the steps of:

providing a safing insulation comprising:

a quantity of safing insulation; and a pre-applied smoke sealant applied to the safing insulation as a liquid and allowed to harden to be secured to the safing insulation;

sizing said safing insulation, including both the quantity of safing insulation and the pre-applied smoke sealant secured to the quantity of safing insulation, to fill at least a portion of a gap defined between two building components to form a sized piece of safing insulation and pre-applied smoke sealant; and inserting the sized piece of safing insulation and pre-applied smoke sealant into the gap.

20. The method of claim 19, further comprising the step of cutting a first piece of the quantity of safing insulation and pre-applied smoke sealant from the safing insulation to form the sized piece of safing insulation, wherein the inserting step further comprises inserting the sized piece of safing insulation and pre-applied smoke sealant cut from the safing insulation sheet into the gap.

21. The method of claim 20, further comprising the steps of cutting a second piece of safing insulation and pre-applied smoke sealant from the safing insulation sheet and inserting the second piece of safing insulation and pre-applied smoke sealant cut from the safing insulation sheet into the gap.

22. The method of claim 19, wherein the pre-applied smoke sealant of the safing insulation sheet allows the passage of no more than five cubic feet of smoke per linear foot of smoke sealant therethrough.

23. The method of claim 19, wherein the safing insulation further comprises:

a plurality of individual sections of safing insulation, each of the plurality of individual sections of safing insulation having an upper surface, each of the plurality of individual sections of safing insulation positioned adjacent to another of the plurality of individual sections of safing insulation to define longitudinal junctions therebetween; and wherein said pre-applied smoke sealant applied to the safing insulation as a liquid and allowed to harden comprises:

a layer of pre-applied smoke sealant positioned on the upper surface of each of the plurality of individual sections of safing insulation, the layer of pre-applied smoke sealant extending across each of the longitudinal junctions between the plurality of individual sections of safing insulation, whereby the layer of pre-applied smoke sealant mechanically secures each of the plurality of individual sections of safing insulation together.

* * * * *

UNITED STATES PATENT AND TRADEMARK OFFICE

CERTIFICATE OF CORRECTION

PATENT NO. : 8,671,645 B1
APPLICATION NO. : 12/609643
DATED : March 18, 2014
INVENTOR(S) : James Shriver It is certified that error appears in the above-identified patent and that said Letters Patent is hereby corrected as shown below:

On the title page: item (73) Assignee: delete "Owens Corning Intellectual Capital, LLC, Toledo, Ohio (US)" and replace with ---Thermafiber, Inc., Wabash, Indiana (US)---.

Signed and Sealed this
Twenty-sixth Day of August, 2014

Michelle K. Lee

Michelle K. Lee
*Deputy Director of the United States Patent and Trademark Office*